US006826898B1

(12) United States Patent
Hummel

(10) Patent No.: US 6,826,898 B1
(45) Date of Patent: Dec. 7, 2004

(54) KNITTABLE YARN AND SAFETY APPAREL

(75) Inventor: Joseph Hummel, Amherst, OH (US)

(73) Assignee: Wells Lamont Industry Group, Perkasie, PA (US)

( * ) Notice: Subject to any disclaimer, the term of this patent is extended or adjusted under 35 U.S.C. 154(b) by 1826 days.

(21) Appl. No.: 08/424,223

(22) Filed: Apr. 19, 1995

Related U.S. Application Data

(63) Continuation of application No. 07/968,209, filed on Oct. 29, 1992, now abandoned, which is a continuation-in-part of application No. 07/651,139, filed on Feb. 6, 1991, now abandoned, and a continuation-in-part of application No. 07/529,241, filed on May 25, 1990, now abandoned, which is a continuation-in-part of application No. 06/788,385, filed on Oct. 17, 1985, now abandoned.

(51) Int. Cl.[7] ..... D02G 3/02
(52) U.S. Cl. ..... 57/210
(58) Field of Search ..... 57/200, 210, 224, 57/229, 230, 902; 2/167, 161.6

(56) References Cited

U.S. PATENT DOCUMENTS

| | | | | |
|---|---|---|---|---|
| 831,108 | A | | 9/1906 | Ryder |
| 2,165,296 | A | | 7/1939 | Oass |
| 2,864,091 | A | | 12/1958 | Schneider |
| 3,087,699 | A | | 4/1963 | Foster |
| 3,145,525 | A | | 8/1964 | Laureti |
| 3,288,175 | A | | 11/1966 | Valko |
| 3,490,224 | A | | 1/1970 | Bourgeas |
| 3,572,397 | A | | 3/1971 | Austin |
| 3,607,822 | A | | 9/1971 | Nishino |
| 3,700,515 | A | | 10/1972 | Terry |
| 3,821,067 | A | | 6/1974 | Taylor et al. |
| 3,871,946 | A | | 3/1975 | Romanksi et al. |
| 3,883,898 | A | | 5/1975 | Byrnes, Sr. |
| 3,895,149 | A | | 7/1975 | Sheffler et al. |
| 3,923,926 | A | | 12/1975 | Harada et al. |
| 3,968,725 | A | | 7/1976 | Holzhauer |
| 4,004,295 | A | | 1/1977 | Byrnes, Sr. |
| 4,267,044 | A | | 5/1981 | Kroplinski et al. |
| 4,384,449 | A | | 5/1983 | Byrnes, Sr. et al. |
| 4,470,251 | A | | 9/1984 | Bettcher |
| 4,526,828 | A | | 7/1985 | Fogt et al. |
| 4,640,950 | A | | 2/1987 | Nishino et al. |
| 4,777,789 | A | | 10/1988 | Kolmes et al. |
| 4,838,017 | A | | 6/1989 | Kolmes et al. |
| 4,912,781 | A | | 4/1990 | Robins et al. |
| 4,936,085 | A | | 6/1990 | Kolmes et al. |
| 5,070,540 | A | * | 12/1991 | Bettcher et al. ..... 2/161.6 Y |
| 5,177,948 | A | * | 1/1993 | Kolmes et al. ..... 57/229 |

FOREIGN PATENT DOCUMENTS

| | | |
|---|---|---|
| DE | 1610495 | 1/1971 |
| DE | 19406 | 9/1982 |
| EP | 0458343 | 11/1991 |
| EP | 0498216 | 8/1992 |
| FR | 1539816 | 8/1968 |
| GB | 187327 | 10/1922 |
| GB | 1401378 | 7/1975 |
| JP | 43-5157 | 3/1968 |
| JP | 4728125 | 4/1971 |

OTHER PUBLICATIONS

The WHIZARD cut–resistant LINER II Glove, 1989, Form 789, no month available.
The WHIZARD KNIFE HANDLER Glove, 1990, Form 990–4, no month available.
The WHIZARD GRIPGUARD Glove, 1985, Bulletin GG 585, no month available.

* cited by examiner

*Primary Examiner*—Danny Worrell
(74) *Attorney, Agent, or Firm*—Watts Hoffmann Co., L.P.A.

(57) ABSTRACT

A cut-resistant, machine knittable, composite yarn that utilizes a yarn or fiber strand or component of normal strength (no greater than 10 grams per denier tenacity) liquid crystal polymer, to provide a composite yarn of comparable high cut-resistance to composite yarns of similar construction that utilize high strength synthetic yarn or fiber. Also protective articles of apparel knitted from such yarn, specifically a cut-resistant protective glove.

8 Claims, 3 Drawing Sheets

KNITTABLE YARN AND SAFETY APPAREL

RELATED APPLICATION

This is a continuation of application(s) Ser. No. 07/968,209 filed on Oct. 29, 1992 now abandoned which is a continuation-in-part of application Ser. No. 07/651,139 filed Feb. 6, 1991 now abandoned and of Ser. No. 07/529,241 filed May 25, 1990 now abandoned, which is a continuation-in-part of Ser. No. 06/788,385 filed Oct. 17, 1985 now abandoned.

TECHNICAL FIELD

The invention relates to yarn suitable for machine knitting and to safety garments made with the yarn.

BACKGROUND ART

Cut-resistant yarn utilizing stainless steel wire strands and high strength aramid strands, such as Kevlar made by E.I Dupont de Nemours Corp., and gloves made therefrom are shown in the Byrnes et al. U.S. Pat. No. 4,384,449 and in the Bettcher U.S. Pat. No. 4,470,251. These gloves have proven highly successful. Another fiber, a high strength stretched polyethylene fiber manufactured and marketed by Allied Corporation, Morris Township, Morris County, N.J., U.S.A., has also provided good cut resistance when used in place of aramid fiber. The Allied fiber is sold under the name Spectra and is described in detail in U.S. Pat. No. 4,413,110 to Kavesh et al. Applicant's copending application Ser. No. 07/529,241 discloses and claims a cut-resistant composite yarn utilizing a high strength yarn or fiber strand or component, made from Vectra liquid crystal polymer sold by Hoechst Celanese Corporation, Charlotte, N.C., under the name Vectran HS. That yarn or fiber has substantially the same strength as high strength aramid fiber sold under the name Kevlar. Heretofore, in applicant's experience, normal strength fibers, when used in composite yarns, have not imparted as great a cut-resistance, along with other desirable characteristics, as high strength fibers have.

DISCLOSURE OF THE INVENTION

The present invention provides a cut-resistant, knittable composite yarn that utilizes a yarn or fiber strand or component of normal strength, made from Vectra liquid crystal polymer, to provide a composite yarn of comparable high cut-resistance to composite yarns of similar construction that utilize high strength synthetic yarn or fiber. The yarn or fiber utilized in the invention is a high performance but normal strength multifilament yarn sold by Hoechst Celanese Corporation, Charlotte, N.C., under the name Vectran M. Normal strength spun yarn made from Vectra is also contemplated. For purposes of definition, normal strength fibers or yarns are those having a tenacity of no more than 10 grams per denier (gpd) and high strength yarns or fibers are those having a tenacity greater than 10 grams per denier, and typically 20 grams per denier or greater (e.g., Kevlar, Spectra and Vectran HS all have a tenacity greater than 20 grams per denier). High strength yarns or fibers also have higher tensile modulus than normal strength fibers, for example, at least 500 grams per denier.

Vectran M has a tenacity of about 9 grams per denier and a tensile modulus of about 425 grams per denier. It has better abrasion resistance than high strength aramid fiber such as Kevlar and significantly better heat resistance than high strength stretched polyethylene fiber, such as Spectra, thus overcoming a different shortcoming of each of Kevlar and Spectra for use in a cut-resistant yarn used for apparel and particularly for cut-resistant gloves. At the same time, quite surprisingly, this normal strength synthetic material provides the substantial advantages that high strength synthetic fibers such as Kevlar, Spectra and Vectran HS have over other normal strength materials in terms of cut-resistance and other characteristics in a composite yarn. Thus, knit fabric suitable for gloves and other safety garments utilizing Vectran M fiber not only has comparable cut-resistance, but also has greater resistance to self-abrasion than similar fabric made with aramid fiber or a combination of aramid and nylon fiber, yet is itself nonabrasive and comfortable to wear. Further, such fabric can be laundered at high temperatures conventionally used for industrial fabrics without degrading the fabric, as occurs with cut-resistant fabric made from yarn that includes high strength stretched polyethylene. In addition, Vectran M has comparable or lower elongation under load to that of high strength fibers, which is advantageous when used in combination with a wire core strand in forming a composite yarn because it protects the wire strand from being broken during knitting or other sharp bending of the composite yarn. Vectran M is consideraby less expensive than Vectran HS, presently about one-half the price.

The present invention provides cut-resistant yarn suitable for machine knitting. Preferred constructions are comprised of a core, a wrapping about the core and another, i.e., second, wrapping about the first and wound in the opposite direction, at least one of said core, first wrapping and second wrapping being comprised of liquid crystal polymer fiber having a tenacity of no more than 10 grams per denier. The denominations such as "first" wrapping and "second" wrapping as used above and in the claims are to differentiate plural wrappings and do not alone indicate that those wrappings are necessarily the first or second relative to the core. Advantageously, neither the core nor the wrappings need comprise a high strength synthetic fiber for the composite yarn to obtain high cut-resistance. Cut-resistance can be enhanced by including a flexible metal strand i.e., wire, as part of the yarn, either as a core element or as a wrapping.

One preferred cut-resistant yarn suitable for machine knitting constructed in accordance with the invention has a core comprised of synthetic fiber and means bundling the core fiber; a wrapping of wire about the bundled core; and two wrappings of synthetic fiber, each wound in an opposite direction over the wrapping of wire; said synthetic fiber of one of said synthetic fiber wrappings or the core or both being a liquid crystal polymer having a tenacity of no more than 10 grams per denier. In a preferred embodiment the means bundling the core fiber comprises two relatively low denier synthetic wrappings each wound in an opposite direction.

Another preferred construction of a cut-resistant yarn embodying the invention has a core having glass fiber, and wrappings about the core, one or preferably two of said wrappings comprising a liquid crystal polymer fiber having a tenacity of no more than 10 gram per denier. Advantageously this yarn has and other preferred yarns have a covering wrap of nylon or polyester.

If a high strength cut-resistant synthetic fiber is desired in the yarn along with a normal strength liquid crystal polymer fiber, e.g., to impart a characteristic not common to the normal strength liquid crystal polymer, it can be selected from, e.g., high strength aramid such as Kevlar 29, high strength stretched polyethylene such as Spectra, and high strength liquid crystal polymer such as Vectran HS.

A further embodiment of the invention utilizes, in place of a strand or strands of flexible metal wire as found e.g. in the above-described embodiments, a limited number of filaments of significant denier (for example, 1 to 50 filaments of a denier of from 10 to 500 each) of liquid crystal polymer fiber having a tenacity of no greater than 10 grams per denier.

The invention further provides a cut-resistant machine-knitted article of apparel, one such article being a flexible glove, at least in part made of yarn having a construction as referred to above.

A glove or other article of apparel utilizing a preferred yarn construction has not only high resistance to cutting, but also good wear qualities and comfort, does not take a set during use, is non-abrasive, provides a good appearance, and is cleanable and long wearing.

The above and other features and advantages of the invention will become more apparent from the detailed description that follows.

BEST MODE FOR CARRYING OUT THE INVENTION

Figure 5:
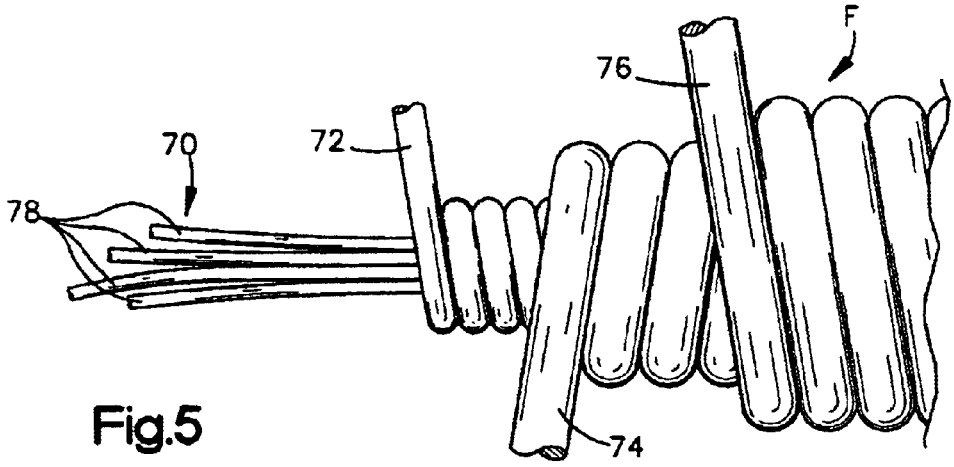
FIG. 5 is a fragmentary, diagrammatic, view of a fifth yarn embodying the present invention.
Figure 6:
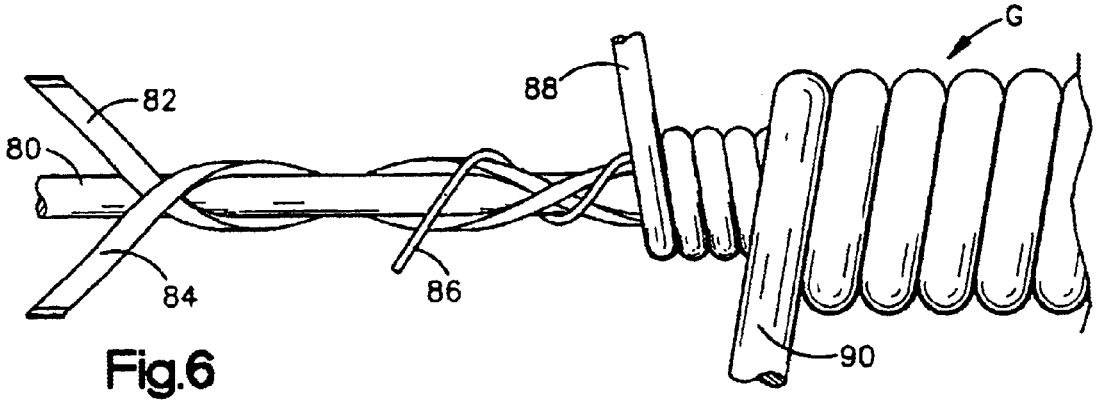
FIG. 6 is a fragmentary, diagrammatic view of a sixth yarn embodying the present invention.
Figure 7:
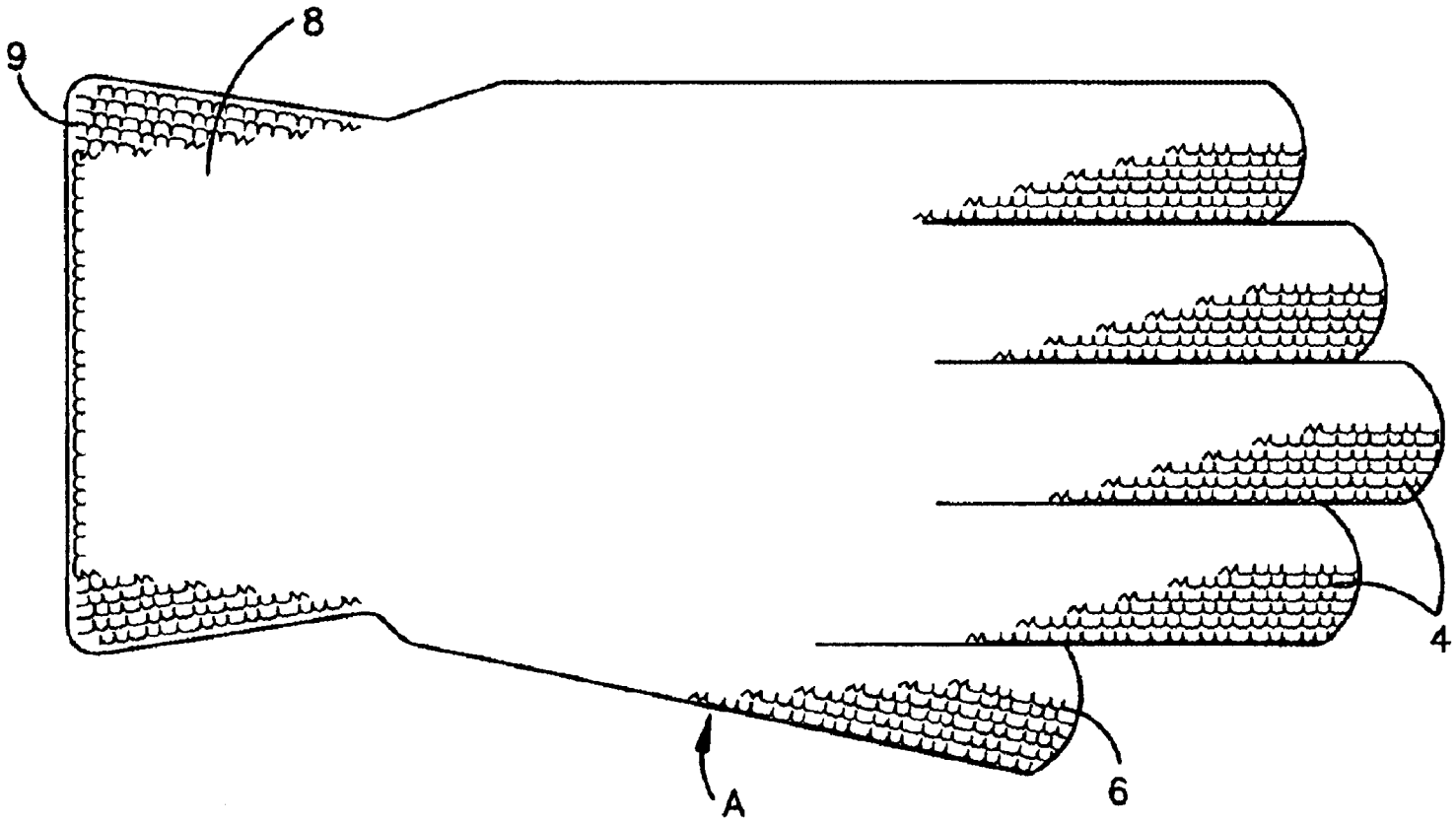
FIG. 7 is a diagrammatic view of an article of apparel, i.e., a knitted glove, made of yarn embodying the present invention, such as any one of the yarns shown in FIGS. 1 to 6.

The glove A depicted in FIG. 6 is exemplary of a safety article of apparel embodying the present invention and is a safety or protective glove suitable to be worn by operatives in the food processing and other industries where sharp instruments or articles, such as knives, or material having sharp edges, for example, sheet metal, glass and the like, are handled, and is made of a composite multistrand yarn B, C, D, E, F or G (FIGS. 1–6) constructed in accordance with the present invention. The glove A has the usual finger and thumb stalls 4, 6 respectively, and a wrist part 8 incorporating an elastic thread or yarn and a cuff trim overwrapping 9. The glove is made using conventional methods and glove knitting machinery.

All of the yarns are constructed of a core and wrappings and fabricated using known upwinding techniques. The core is a central strand or strands that extends or extend longitudinally of the length of the yarn. The wrappings or wraps are strands wound about the core in successive turns that may or may not be in contact each to the next. All of the yarns utilize a strand of liquid crystal polymer fiber having a tenacity no greater than 10 grams per denier. The preferred constructions of the yarns embodying this invention include no high strength synthetic fibers such as high strength aramid, high strength stretched or extended chain polyethylene, or high strength liquid crystal polymer, which provide only comparable cut-resistance and in many instances have disadvantages.

Metal wire, especially fully annealed stainless steel, is utilized in several of the preferred embodiments, as either a core element or as a wrapping, and could be used as both, to contribute to high cut-resistance. Number 304 stainless steel, fully annealed, which has a tensile strength of about 110,000 to 140,000 pounds per square inch, is believed to have optimum flexibility and life. Other embodiments utilize glass fiber or a few high denier filaments of liquid crystal polymer fiber having a tenacity no greater than 10 grams per denier, sometimes in lieu of metal wire and its function.

The liquid crystal polymer fiber utilized in the embodiments of this invention and having a tenacity of no greater than 10 grams per denier, has a tensile strength greater than that of stainless steel wire and an elongation of less than that of the wire. Vectran M has an initial tensile modulus of about 400 to 500 grams per denier, typically 425 grams per denier. It has a tenacity (tensile strength at break) of from 8 to 10 grams per denier, typically 9, and its elongation at break is about 2.0 percent.

The overall diameter of the yarns of this invention should be no greater than 0.05 inch and preferably no greater than 0.03 inch to facilitate machine knitting. In practice, a range of from 0.005 inch to 0.035 inch will provide cut-resistant yarn of desirable qualities.

Figure 1:
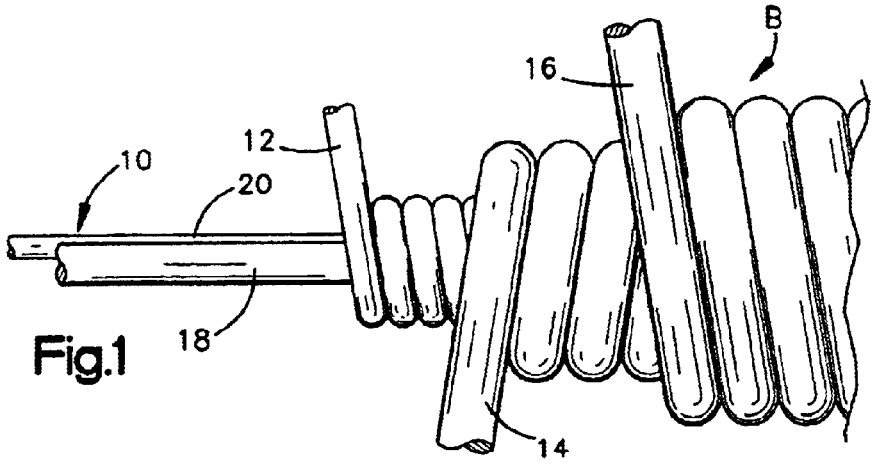
FIG. 1 is a fragmentary, diagrammatic, view of a yarn embodying the present invention.

One preferred embodiment of the invention is shown in FIG. 1 of the drawings. A yarn B suitable for being machine knit to form the glove A comprises a core part 10 and three windings 12, 14, 16 of synthetic fiber wound about the core in opposite directions, each successive one on top of the previous one. The fact that each successive wrapping 14, 16 is in a different direction from the previous one balances the forces incident to the wrappings so the yarn has no unusual twist or tendency to coil and assists in holding the wrappings in place on the core 10. The core 10 has a strand 18 of 900 or 1500 denier multifilament liquid crystal polymer fiber having a tenacity no greater than 10 grams per denier, such as Vectran M, and a fully annealed stainless steel wire 20, 0.003 inch in diameter. The wrapping 12 is a strand of 440 denier multifilament liquid crystal polymer fiber having a tenacity no greater than 10 grams per denier and wrapped at a rate of 8–10 turns per inch about the core, and the wrappings 14, 16 are each 420 denier nylon wrapped at the rate of 8–12 turns per inch, but alternatively can be polyester of that denier. The use of a multifilament normal strength liquid crystal polymer fiber strand, such as Vectran M fiber strand, in the core is advantageous. Multifilament strand is very linear and slides and/or flows well relative to any other part of the core during fabrication and subsequent use of an article of apparel produced therewith. The normal strength multifilament core strand, which is relatively unstretchable, takes a great deal if not the major part of the tensile load to which the yarn is subjected during knitting. It also appears to increase the flexibility of the core part of the yarn over an all metal core and in turn makes the yarn more easily knit, i.e., imparts to the yarn greater knittability. It also improves cut-resistance. The use of multifilament normal strength liquid crystal polymer fiber such as Vectran M fiber as a wrapping contributes significantly to the cut-resistance of the yarn. The first wrapping 12 provides a desirable rigid backup surface for the outer wrappings 14, 16, each of which tends to fill out the valleys of the wrapping immediately therebeneath. The multifilament wrappings 12, 14, 16 wind flat about the core, producing a yarn with a smooth surface that aids the knitting process and that has a good appearance, a non-abrasive surface, and that provides heat resistance and maximum comfort.

Figure 2:
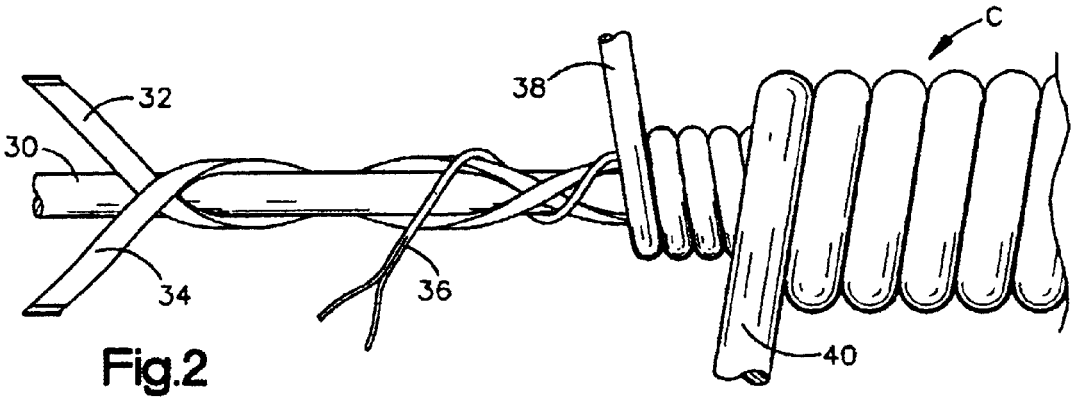
FIG. 2 is a fragmentary, diagrammatic, view of a second yarn embodying the present invention.

Another preferred embodiment of the invention is shown in FIG. 2 of the drawings. A yarn C comprises a core part 30 and multiple wrappings 32, 34, 36, 38 and 40 applied one after the other and except for the wrapping 36, each is wound helically in an opposite direction from the preceding one, which helps balance forces incident to the wrappings so the yarn has no unusual twist or tendency to coil and assists in holding the wrappings in place on the core. The core part 30 is a multifilament strand of 750 denier liquid crystal polymer fiber having a tenacity no greater than 10 grams per denier, such as Vectran M. The first two wrappings are identical but wound in opposite directions about the core 30 and are each 70 denier multifilament nylon fiber and wrapped at a rate of six turns per inch along the core. These two wrappings bundle the filaments of the core so they present a unified mass rather than a spread out and thinner layer of fibers to a sharp object, to which the core may be exposed when the yarn is in use, and it is believed to be more difficult to cut through such an arrangement of bundled multiple filaments. The bundled core filaments also present a substantially cylindrical and desirably uniform shape about which to wind subsequent wrappings. The third wrapping 36 is two (or alternatively, preferred embodiments may use one to three) fully annealed stainless steel wires each 0.0016 inch in diameter that are together wound as a strand in one direction about the core 30 and the first two wrappings 32, 34 at a rate of 8 turns per inch, uniformly spaced. The length of this wire is approximately 35 percent greater than the length of the core strand, and hence greater by the same amount than the length a straight core wire would be if used, thereby providing an increased amount of steel in the yarn over a straight core wire of the same diameter. By virtue of the helical shape of the wire, a knife blade or other sharp object approaching the yarn at an angle other than that of the wire helix will tend to have to cut through the wire of each composite yarn strand at more than one location, thereby meeting increased resistance over a core wire that, being straight, only interrupts the cutting path once. The fourth wrapping 38 is a 400 denier strand of liquid crystal polymer fiber having a tenacity no greater than 10 grams per denier, such as Vectran M, wrapped in the opposite direction from that of the wire and the wrapping 34, with each turn directly adjacent the next to provide a substantially complete covering to the third wrapping. The fifth wrapping 40 is a strand of 840 denier nylon, or alternatively polyester, fiber wrapped in the opposite direction to the fourth wrapping, with each turn directly adjacent the next to provide a substantially complete covering to the fourth wrapping. While of relatively low cut-resistant material, the fifth wrapping adds body to the yarn and provides good comfort and feel to a garment made from the yarn because the material is soft, flexible and non-abrasive. The finished diameter of the yarn is between 0.020 and 0.030 inch, and preferably not greater than 0.025 inch, to facilitate machine knitting on conventional knitting machines.

Figure 3:
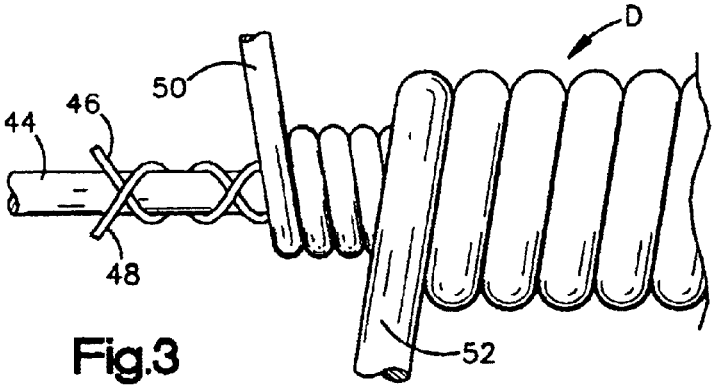
FIG. 3 is a fragmentary, diagrammatic, view of a third yarn embodying the present invention.

Another preferred embodiment of the invention is shown in FIG. 3. A yarn D has a core strand 44 of 1500 denier liquid crystal polymer fiber having a tenacity no greater than 10 grams per denier, such as Vectran M, a first and second wrapping 46, 48 each of a fully annealed stainless steel wire 0.003 inch in diameter and each wrapped in an opposite direction from the other about the core, eight turns per inch. Alternatively, one of the wire wrappings can be omitted for more flexibility where less cut-resistance is needed. A third wrapping 50 of 400 denier liquid crystal polymer fiber having a tenacity no greater than 10 grams per denier, such a Vectran M, is wound about the core and wire with turns directly adjacent, each to the next, to substantially cover the core and wire. A fourth wrapping 52 of 630 denier nylon, or alternatively polyester, is wound about the third wrapping with turns directly adjacent, each to the next, and in an opposite direction from the turns of the third wrapping. Alternatively, the third and fourth wrappings 50, 52, can both be of 400 denier liquid crystal polymer fiber having a tensile modulus no greater than 10 grams per denier, wound about the core and wire, each in an opposite direction from the other, and each with turns directly adjacent to provide a substantially complete covering, to provide greater cut-resistance, but without the softness and flexibility of the yarn having a fourth wrapping of nylon or polyester.

Figure 4:
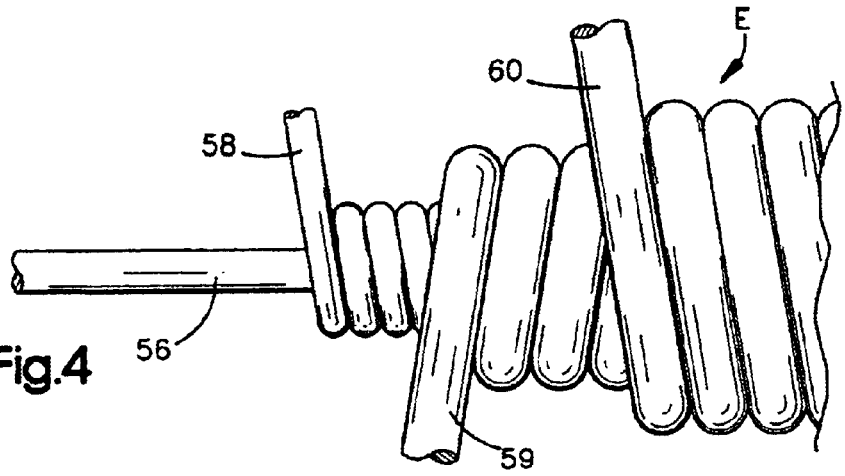
FIG. 4 is a fragmentary, diagrammatic, view of a fourth yarn embodying the present invention.

Another preferred yarn E embodying the invention is shown in FIG. 4. A core 56 of 600 denier glass fiber, E glass, or alternatively S glass, preferably filament, is wound with a first and a second wrapping 58, 59 each of 750 denier liquid crystal polymer fiber having a tenacity no greater than 10 grams per denier, such as Vectran M, each wound in an opposite direction from the other and each with its turns directly adjacent so the first substantially covers the core and the second substantially covers the first, and a third wrapping 60 of 400 denier nylon fiber or alternatively polyester fiber having directly adjacent turns.

Another preferred yarn F embodying the invention is shown in FIG. 5 and comprises a core part 70 and three windings 72, 74, 76 of synthetic fiber wound thereon in opposite directions each successive one on top of the previous one. The fact that each successive wrapping 74, 76 is in a different direction from the previous one balances the forces incident to the wrappings so the yarn has no unusual twist or tendency to coil and assists in holding the wrappings in place on the core 70. The core 70 has four filaments 78 of 200 denier liquid crystal polymer fiber having a tenacity no greater than 10 grams per denier, such as Vectran M. In other preferred embodiments of similar construction, the core can have a total denier of 200 to 1500 comprised of from one to 50 filaments or ends, each of which has a denier of from about 4 to about 500. The use of relatively few filaments of relatively high denier, preferably at least 20 denier each, results in a core strand behaving somewhat like a monofilament core and allows the liquid crystal polymer to function similarly to a steel wire core element and thereby permits the elimination of the wire, e.g., the wire used in the embodiment of FIG. 1, and without the need for another strand normal or high strength synthetic fiber of low elongation and high cut-resistance along with it, as required with a core wire to protect it from breakage. The wrapping 72 is a strand of 440 denier liquid crystal polymer fiber having a tenacity no greater than 10 grams per denier, such as Vectran M, and wrapped at a rate of 8–10 turns per inch about the core, and the wrappings 74, 76 are each 440 denier nylon wrapped at the rate of 8–12 turns per inch, but alternatively can be polyester of that denier.

Another preferred yarn G embodying the invention is shown in FIG. 6 and comprises a core part 80 of 440 or 220 denier multifilament polyester fiber, two identical wrappings 82, 84 wound in opposite directions about the core 80, each of 70 denier multifilament nylon fiber and wrapped at a rate of six turns per inch, to bundle the filaments of the core. A third wrapping 86 is a single strand of 0.0016 inch diameter fully annealed stainless steel wire wrapped at a rate of 8 turns per inch, uniformly spaced. A fourth wrap 88 is 400 denier liquid crystal polymer fiber having a tenacity no greater than 10 grams per denier, such as Vectran M, wrapped in the opposite direction from that of the wire, with each turn directly adjacent the next to provide a substantially complete covering to the third wrapping. A fifth wrapping 90 is a strand of 1300 microdenier polyester wrapped in the opposite direction to the fourth wrapping with each turn directly adjacent the next to provide a substantially complete covering to the fourth wrapping. The finished diameter of the yarn is between 0.020 and 0.030 inch, and preferably not greater than 0.025 inch, to facilitate machine knitting on conventional knitting machines. The outer wrapping of microdenier polyester provides a soft and comfortable feel, is readily cleanable, is attractive and has good wear characteristics.

While specific deniers and other features of preferred embodiments have been set forth, different values can be selected within acceptable ranges to provide useful cut-resistant yarns. The specific values selected will of course cause a variation in cut-resistance, flexibility, weight and thickness of the yarn and the fabric knitted therefrom, and cost. It is contemplated that the normal strength liquid crystal polymer fiber, such as Vectran M, when used in the core or as a wrapping of a yarn embodying the invention, will have a denier of from 200 to 3000, and more typically from 200 to 1500. The nylon or polyester fiber used as an outer wrapping of a yarn embodying the invention will have a denier of from 200 to 2000 and more typically from 200 to 1500. When a synthetic fiber, such as nylon or polyester fiber is used as an inner wrapping to bundle the core fibers, it will have a denier of from 50 to 400 and more typically from 50 to 120. The cut-resistance of a yarn containing metal wire is in part a function of the quantity of metal wire in the yarn, and flexibility is in part a function of the diameter of the metal wire. Multiple metal strands are advantageous for flexibility over one larger strand where increased cut-resistance is desired. Other kinds of metal wire strands, if desired for special purposes, may be used, such as aluminum, copper, bronze or steel. Stainless steel wire used as a core or wrapping will have a diameter from 0.001 to 0.010 inch and more typically from 0.001 to 0.006 inch. The various wrappings about the core will have from 2 to 20 turns per inch. Preferably, the stainless steel wrappings will have from 2 to 12 turns per inch and more preferably 4 to 12, the core-bundling wrappings will have from 2 to 20 turns per inch and more preferably 4 to 20, the normal strength liquid crystal polymer fiber wrappings will have from 8 to 12 turns per inch, and the covering wrappings will have whatever number of turns is needed to provide adequate covering with each turn adjacent the next, typically 8 to 12.

The depicted glove A when knit from any of the yarns B–G is a safety glove especially advantageous for use in the food processing industries and is highly cut-resistant, abrasive-resistant, readily cleanable at high temperatures, comfortable to wear, nice appearing, flexible and relatively non-absorbent, all of which are important in food processing industries. The glove is highly chemical-resistant and fatigue resistant, and resistant to the transfer of heat or cold, is conformable, does not acquire a set during use, is non-shrinkable, is light in weight, and provides a secure grip. At the same time, gloves knit from yarn described above using normal strength liquid crystal polymer fibers, such as Vectra M fibers, in place of comparable quantities of high strength synthetic fibers, provide essentially equal or in some cases better, cut-resistance over gloves knit with yarn that utilizes comparable quantities of high strength fiber.

While the yarn of the invention has been described and shown incorporated into a knit safety glove, it is to be understood that the yarn of the present invention can be used to make other fabrics and articles of apparel, safety or otherwise, such as wrist guards, protective sleeves, gaiters, safety aprons, etc. for use in the meat processing and other industries.

It is apparent from the foregoing that variations in certain of the materials and sizes of the strands employed in preferred embodiments of the invention herein described can be made, the advantages of the invention heretofore enumerated and others have been accomplished, and there have been provided an improved knittable yarn and safety articles of apparel made therewith having superior qualities. While preferred embodiments of the invention have been described in considerable detail, various modifications or alterations may be made therein without departing from the spirit or scope of the invention set forth in the appended claims.

What is claimed is:

1. A cut-resistant yarn suitable for machine knitting, comprising a core, a first wrapping about the core and a second wrapping about the first, at least one of said core, first wrapping and second wrapping being comprised of cut-resistant liquid crystal polymer fiber having a tenacity of no more than 10 grams per denier wherein the core is comprised of said liquid crystal polymer fiber.

2. A cut-resistant yarn as set forth in claim 1 wherein the first wrapping is comprised of said liquid crystal polymer fiber.

3. A cut-resistant yarn as set forth in claim 1 wherein one of the first and second wrappings is comprised of synthetic fiber having a tenacity no greater than 10 grams per denier.

4. A cut-resistant yarn as set forth in claim 3 wherein said synthetic fiber of said one wrapping is said liquid crystal polymer fiber.

5. A cut-resistant yarn suitable for machine knitting having: a core comprised of a liquid crystal polymer fiber having a tenacity of no more than 10 grams per denier, a flexible metal strand; a wrapping of liquid crystal polymer fiber having a tenacity of no more than 10 grams per denier, and one or more additional wrappings of synthetic fiber none of which has a tenacity greater than 10 grams per denier.

6. A cut-resistant yarn as set forth in claim 5 wherein the metal strand is annealed stainless steel of diameter from 0.001 to 0.006 inch, the liquid crystal polymer fiber of the core and wrapping each has a denier of from 200 to 3000, and each of the one or more additional wrappings of synthetic fiber has a denier of from 200 to 1500.

7. A cut-resistant yarn suitable for machine knitting having a core comprised of a liquid crystal polymer fiber having a tenacity of no more than 10 grams per denier and a strand of wire, and having wrappings comprised of a wrapping of liquid crystal polymer fiber having a tenacity of no more than 10 grams per denier, and two wrappings each of which is either nylon or polyester over the liquid crystal polymer wrapping.

8. A cut-resistant yarn as set forth in claim 7 wherein the strand of wire is stainless steel having a diameter of from 0.001 to 0.006, the liquid crystal polymer fiber of the core and of the wrapping have a denier of from 200 to 3000, and each of the said two wrappings has a denier of from 200 to 1500.

* * * * *